US005359857A

United States Patent [19]

Honda

[11] Patent Number: 5,359,857

[45] Date of Patent: Nov. 1, 1994

[54] INSTALLATION FOR AIR LIQUEFACTION SEPARATION AND PROCESS THEREFOR

[75] Inventor: Hideyuki Honda, Kawasaki, Japan

[73] Assignee: Nippon Sanso Corporation, Tokyo, Japan

[21] Appl. No.: 60,017

[22] Filed: May 10, 1993

[30] Foreign Application Priority Data

May 8, 1992 [JP] Japan ..... 4-116186

[51] Int. Cl.[5] ..... F25J 3/02

[52] U.S. Cl. ..... 62/24; 62/39

[58] Field of Search ..... 62/24, 39

[56] References Cited

U.S. PATENT DOCUMENTS

| | | | |
|---|---|---|---|
| 4,872,893 | 10/1989 | Agrawal et al. | 62/11 |
| 5,037,462 | 8/1991 | Scheigert | 62/24 |
| 5,123,947 | 6/1992 | Agrawal | 62/27 |
| 5,129,932 | 7/1992 | Agrawal et al. | 62/22 |
| 5,137,559 | 8/1992 | Agrawal | 62/24 |

FOREIGN PATENT DOCUMENTS

| | | |
|---|---|---|
| 0376465 | 7/1990 | European Pat. Off. . |
| 4017410 | 12/1990 | Germany . |
| 61-225568 | 7/1986 | Japan . |
| 61-123389 | 8/1986 | Japan . |
| 61-228286 | 10/1986 | Japan . |
| 62-141485 | 6/1987 | Japan . |
| 412391 | 3/1992 | Japan . |
| 4121575 | 4/1992 | Japan . |
| 4227462 | 8/1992 | Japan . |

*Primary Examiner*—Ronald C. Capossela
*Attorney, Agent, or Firm*—Thompson, Hine and Flory

[57] ABSTRACT

An air liquefaction separation installation is provided with a rectification column which have a carbon monoxide rectification part connected to the upper part of the rectification column and at upper part of its rectification parts or a main condensation evaporator, a collecting part is provided for withdrawing a part of nitrogen gas having reduced amount of carbon monoxide and/or liquified nitrogen; and a carbon monoxide-containing nitrogen gas withdrawal part and/or liquefied nitrogen gas withdrawal part, connected to the lower part of the carbon monoxide rectification part. According to the present invention, carbon monoxide is removed from nitrogen by a rectification process. Accordingly, cost for installation and operation can be reduced.

12 Claims, 6 Drawing Sheets

AIR
GN
WN
GO
PGN
PLN
1
5
6
7
8
8a
10
11
13
16
17
18
20
21
22
23
24
30
31
31a
32
32a
33
34
40
41
42
43
44
45
46
47

INSTALLATION FOR AIR LIQUEFACTION SEPARATION AND PROCESS THEREFOR

BACKGROUND OF THE INVENTION

1. Field of the Invention

The present invention relates to installation and process for separating air by liquefaction; specifically, the invention relates to installation and process for producing extremely pure nitrogen which may be used in processes for producing semiconductors. The invention relates, in particular, to installation and process for separation and removal of carbon monoxide by a rectification process.

2. Description of Related Art

Requirements for acceptable levels of impurities contained in ultrapure nitrogen gas have become stricter in recent years. Particularly strict requirements for such acceptable concentrations of impurities in nitrogen are, for example, under 1 ppb of oxygen, under 1 ppb of methane, under 10 ppb of hydrogen, under 1 ppb of carbon dioxide, under 1 ppb of carbon monoxide, and under 5 ppb of water. Hence, great numbers of means and devices for producing ultrapure nitrogen by liquefying and separating air have been proposed corresponding to the requirements.

Carbon monoxide is contained in the air in small quantities, and has a boiling point of −191.5° C., which is close to the boiling point of nitrogen which is −196° C. Therefore, it was believed that separation of nitrogen and carbon monoxide by a rectification process would be costly. Hence, carbon monoxide was oxidized into carbon dioxide by a catalytic reaction, and the thus-produced carbon dioxide was then removed by a process such as adsorption.

FIG. 6 shows a conventional air liquefaction separation installation in which a process of removing carbon monoxide and hydrogen by a catalytic reaction is adopted. Feed air which is compressed by a compressor 1 is heated by a heat exchanger 2 and a heater 3, and is then introduced into a catalytic reaction column 4. In the catalytic reaction column 4, carbon monoxide and hydrogen contained in the feed air react with oxygen so as to be converted into carbon dioxide and water. Next, the feed air is cooled by the heat exchanger 2 and a cooler 5, and is then introduced into an adsorber 6 by means of which impurities such as water and carbon dioxide gas are adsorbed and removed.

The thus-purified feed air which passed through the adsorber 6 is cooled to its approximate saturated temperature by a main heat exchanger 7, by means of which the purified feed air is heat-exchanged with the various feedback gases. Then the purified feed air is introduced into a lower part of lower column 8 of a double rectification column. By the rectification action in the lower column 8, the purified feed air is separated into pure nitrogen gas in the upper part of the lower column 8 and oxygen-enriched liquefied air in the lower part thereof.

A part of the pure nitrogen gas flows out of the upper part of the lower column 8 through a pipe 9, and then flows through a pipe 10 towards an expansion turbine 11. The remainder of the pure nitrogen gas flows into a main condenser evaporator 13 via a pipe 12, and is therein liquified into pure liquified nitrogen. The pure liquified nitrogen is then withdrawn by a pipe 14. A part of this pure liquified nitrogen is discharged from a pipe 15 as a product (PLN). Another part of the purified liquified nitrogen flows into the top of an upper column 18 via a pressure reducing valve 16 and a pipe 17. The remaining part which is the largest fraction of the pure liquified nitrogen flows through a pipe 19, and then flows into the upper part of the lower column 8, so as to be used as a reflux liquid.

At the same time, the aforesaid oxygen-enriched liquified air in the lower part of the lower column 8 is introduced into a middle stage in the upper column 18 via a pipe 20 and a pressure reducing valve 21. In the upper column 18, the oxygen-enriched liquified air and the above-described pure liquified nitrogen which was introduced into the upper part of the upper column 18 are rectified so as to be separated into liquified oxygen in the lower part of the upper column 18 and nitrogen gas in the upper part of the same.

Oxygen gas (GO) which was gasified by the aforesaid main condenser evaporator 13 is discharged from the lower part of the upper column 18 via a pipe 22 as a product. At the same time, pure nitrogen gas (GN) flows from the upper part to a pipe 23, and an impure nitrogen gas (waste gas (WN)) flows from the upper part of the middle stage of the column to a pipe 24.

The thus-obtained extremely pure liquified nitrogen and pure nitrogen gas have only trace amounts of carbon monoxide and hydrogen, since these substances were previously removed by catalytic reactions.

In addition, the reflux ratio (L/V) at a rectification part 8*a* in the lower column 8 of this conventional example is normally approximately between 0.5 and 0.7.

Despite the above-stated advantages of the prior art, a facility for removing carbon monoxide by employing the above-stated catalytic reaction is expensive, and great pressure losses increase the required power and thus increase costs. Also, it is difficult to remove inert low boiling point components such as helium (approximately 1 ppm contained in the atmosphere) and neon (approximately 1.8 ppm contained in the atmosphere) according to the above-described method.

SUMMARY OF THE INVENTION

It is an object of the present invention to provide installation and process for air liquefaction separation in which carbon monoxide is removed by rectification and in which the cost of the facility and operation thereof can be reduced.

In order to achieve the above-stated object, the first structure of the air liquefaction separation installation of the present invention provides an air liquefaction separation installation which comprises a rectification column having a condenser evaporator thereabove and which isolates at least one atmospheric constituent, such as oxygen and nitrogen, and nitrogen within which the amount of carbon monoxide is reduced, wherein the isolation is carried out by introducing compressed, refined, and cooled feed air into said rectification column and carrying out liquefaction rectification separation, said air liquefaction separation installation further comprising:

- a carbon monoxide rectification part in the upper part of said rectification column;
- a collecting part for withdrawing a part of nitrogen gas and/or liquefied nitrogen within which the amount of carbon monoxide is reduced, said collecting part connected to the upper part of said carbon monoxide rectification part or to said condenser evaporator; and a carbon monoxide-containing nitrogen withdrawal part connected to the lower part of said carbon monoxide rectification part.

The second structure of the present invention is a structure according to the first structure, wherein said carbon monoxide rectification part has more than 10 theoretical plates.

The third structure of the present invention is a structure according to the first structure, wherein said rectification column is a lower column of a double rectification column.

The fourth structure of the present invention is a structure according to the first structure, wherein said rectification column is a single rectification column.

The fifth structure of the present invention is a structure according to the first structure, wherein in addition to said rectification column, said air liquefaction separation installation further comprises a low boiling point component separation column comprising:

a liquefied nitrogen introduction part for introducing, as a reflux liquid, liquefied nitrogen within which the amount of carbon monoxide is reduced, and a low boiling point component exhaust part for withdrawing nitrogen gas containing low boiling point components, said liquefied nitrogen introduction part and said low boiling point component exahaust part connected to the upper part of said low boiling point component rectification column; and an evaporator and a withdrawal part for withdrawing nitrogen within which the amount of carbon monoxide and low boiling point components are reduced, said evaporator and said withdrawal part for withdrawing nitrogen disposed in lower part of said low boiling point component rectification column.

The sixth structure of the present invention is a structure according to the fifth structure, wherein said air liquefaction separation installation further comprises a pure argon column which is provided connectively to said low boiling point component separation column, whereby said evaporator is also used as a condenser for said pure argon column.

The seventh structure of the present invention is a structure according to the first structure, wherein said air liquefaction separation installation further comprises:

a low boiling point component rectification part above said carbon monoxide rectification part in the upper part of said rectification column;

a withdrawal part for withdrawing nitrogen gas which contains low boiling point components, such as hydrogen, and an introduction part for introducing liquefied nitrogen which is liquefied in said condenser evaporator, said withdrawal part for withdrawing nitrogen gas and said introduction part for introducing liquefied nitrogen connected to the upper part of said low boiling point component rectification part; and a withdrawal part for withdrawing nitrogen gas and/or liquefied nitrogen within which the amount of carbon monoxide is reduced, said withdrawal part for withdrawing nitrogen gas and/or liquefied nitrogen disposed between said low boiling point component rectification part and said carbon monoxide rectification part.

The eighth structure of the present invention is a structure according to the first structure, wherein said air liquefaction separation installation further comprises:

a low boiling point component rectification part above said carbon monoxide rectification part in the upper part of said rectification column;

a withdrawal part for withdrawing nitrogen gas which contains low boiling point components, such as hydrogen, and an introduction part for introducing liquefied nitrogen which is liquefied in said condenser evaporator, said withdrawal part for withdrawing nitrogen gas and said introduction part for introducing liquefied nitrogen connected to the upper part of said low boiling point component rectification part; and a flow channel for withdrawing nitrogen gas from the upper part of said low boiling point component rectification part and to introducing said nitrogen gas to said condenser evaporator, for said flow channel disposed between said low boiling point component rectification part and said carbon monoxide rectification part.

The ninth structure of the present invention is a structure according to the seventh or eighth structure, wherein said low boiling point component rectification part has from 1 to 5 theoretical plates.

In addition, the present invention provides an air liquefaction separation process for isolating products of at least one atmospheric constituent and nitrogen within which the amount of carbon monoxide is reduced, whereby compressed, refined, and then cooled feed air is introduced into a rectification column which comprises a condenser in the upper part of said rectification column so as to carry out liquefaction rectification separation, said air liquefaction separation process comprising by the steps of:

carrying out rectification so that the reflux ratio at a carbon monoxide rectification part provided in the upper part of said rectification column is no less than 0.85; and withdrawing nitrogen gas and/or liquefied nitrogen having reduced amount of carbon monoxide from the upper part of said rectification column.

According to the above structures, nitrogen containing carbon monoxide is isolated by a conventional rectification part, and it is then rectified by the carbon monoxide rectification part so as to separate carbon monoxide. In the carbon monoxide rectification part, carbon monoxide is concentrated in the lower part, and nitrogen gas containing trace carbon monoxide is obtained from the upper part.

Most or all of this nitrogen gas containing trace carbon monoxide flows into a condenser and is liquefied therein into liquefied nitrogen containing trace carbon monoxide. A portion of the liquefied nitrogen is withdrawn, and the remaining which is the largest portion is used as a reflux liquid so that a reflux ratio in the carbon monoxide rectification part is adjusted to 0.85 or higher.

Low boiling point components such as hydrogen are contained in the withdrawn liquefied nitrogen. The low boiling point components can be separated and removed by introducing this liquefied nitrogen into a low boiling point component separation column (a hydrogen separation column) as described in the above structures. According to this process, the low boiling point components such as hydrogen can be removed, and an ultrapure nitrogen can be obtained.

Furthermore, by providing the low boiling point component rectification part above the carbon monoxide rectification part of the rectification column, the low boiling point components can be removed by rectification separation in the low boiling point component rectification part, and thus an ultrapure nitrogen can be obtained between the carbon monoxide rectification part and the low boiling point component rectification part.

According to the present invention, carbon monoxide and nitrogen can be separated simply by rectification processing, facility cost and power cost can be reduced, and ultrapure nitrogen can be produced at a low cost. Furthermore, not only carbon monoxide, but also argon and oxygen contaminants in nitrogen can be removed by the carbon monoxide rectification part, and therefore the concentrations of these impurities can be reduced.

Although it has been difficult to economically reduce the argon contamination of nitrogen to 1 ppm or lower by using a conventional apparatus for isolating ultrapure nitrogen, the present invention enables the argon concentration to be reduced to 1 ppm or lower while carbon monoxide is also removed.

Furthermore, helium and neon, which could not be removed by conventional catalytic reactions, can be removed by rectification in the case where the low boiling point component separation column or the low boiling point component rectification part is provided.

Accordingly, nitrogen containing almost no hydrogen, helium, neon, carbon monoxide, oxygen, argon, and the like, and having the purity of 99.9999% or higher, can be easily obtained.

DETAILED DESCRIPTION OF THE PREFERRED EMBODIMENTS

The present invention can be more fully understood from the following detailed description of embodiments with reference to the drawings. In the case where an element of an embodiment is identical to that of an element of the above-described conventional installation, identical numerals have been attached. Detailed descriptions of such identical elements in the present embodiments have therefore been omitted.

Figure 1:
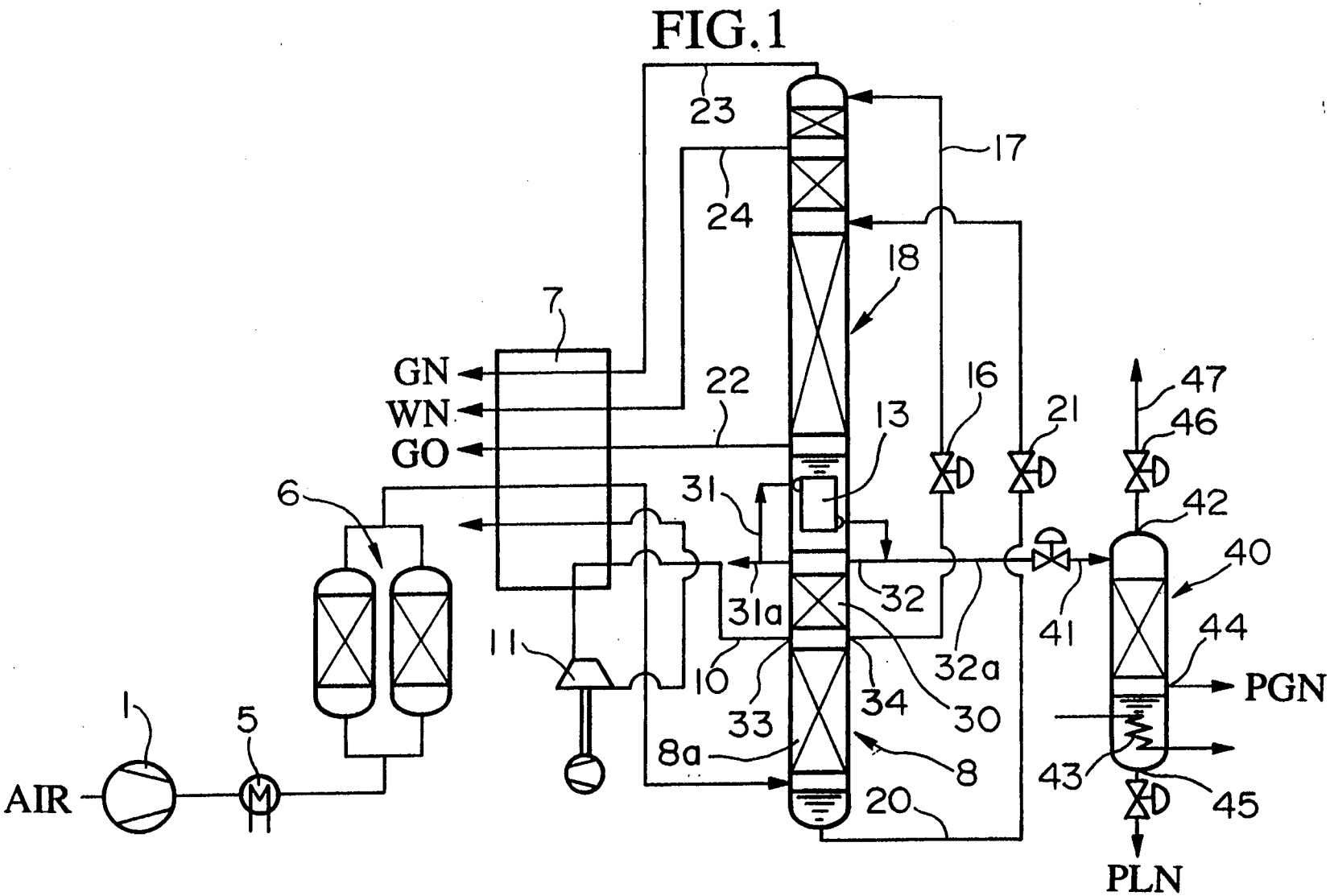
FIG. 1 is a schematic drawing showing a first embodiment of the present invention.

FIG. 1 shows a first embodiment of the present invention.

Figure 6:
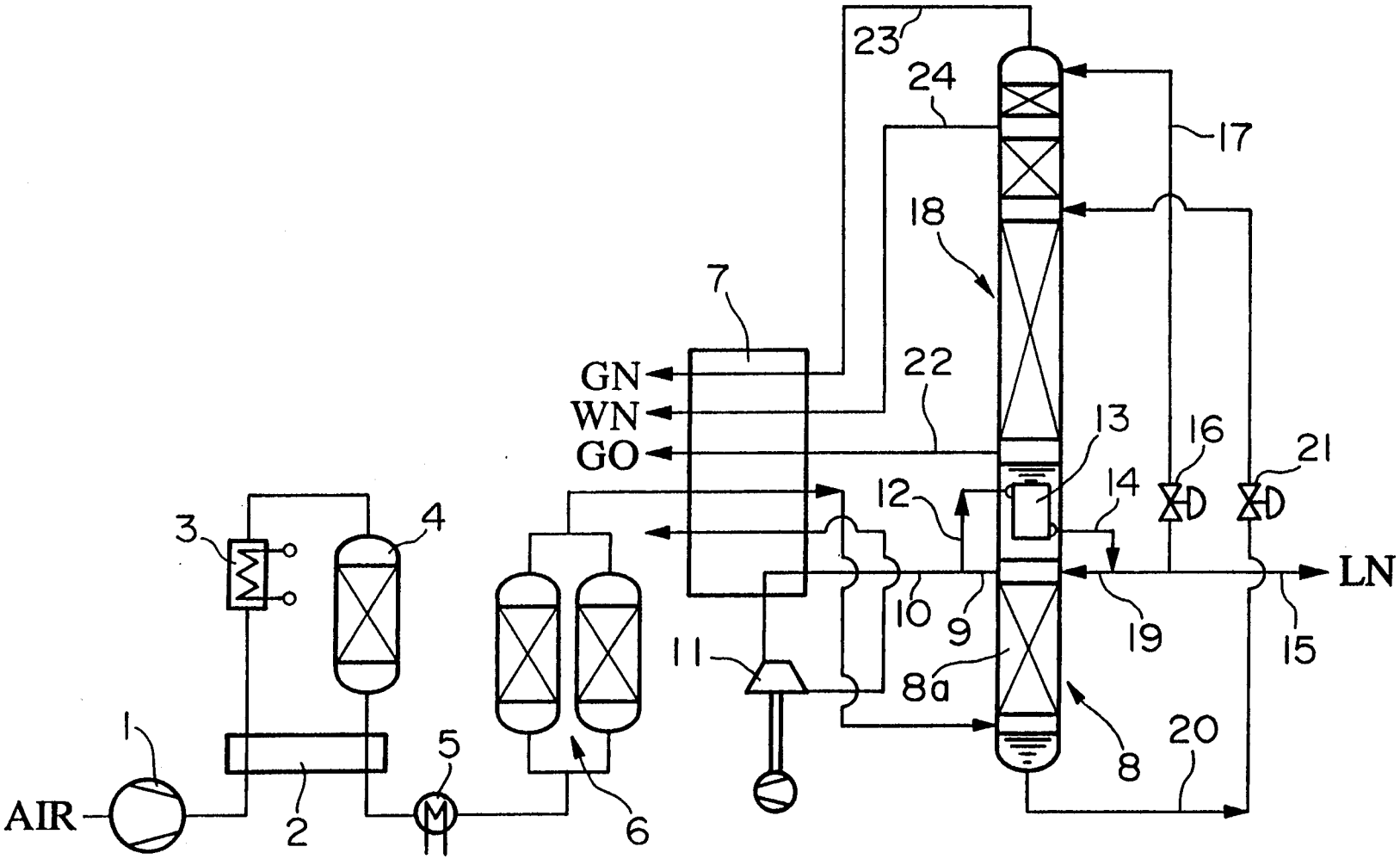
FIG. 6 is a schematic drawing showing an example of a conventional air liquefaction separation installation.

An air liquefaction separation installation according to this embodiment does not have a catalytic reaction system as has the installation shown in FIG. 6, i.e., a heat exchanger 2, a heater 3, and a catalytic reaction column 4. In place of the catalytic reaction system, the air liquefaction separation installation of this embodiment is provided with:

a carbon monoxide rectification part 30, having a number of theoretical plates of more than 10, preferably more than 14, above a conventional rectification part 8*a* in a lower column 8;

flow channels 31, 32, 31*a*, and 32*a* connected to the upper part of the carbon monoxide rectification part 30, wherein: the flow channel 31 withdraws nitrogen gas having reduced carbon monoxide and then introduces it into a main condenser evaporator 13; the flow channel 32, carries nitrogen liquefied by the main condenser evaporator 13 to the upper part of the lower column 8; and the flow channels 31*a* and 32*a* withdraw a part of the nitrogen gas and a part of the liquefied nitrogen, within which the amount of carbon monoxide is reduced, respectively; and a carbon monoxide-containing nitrogen gas withdrawal part 33 and a liquefied nitrogen withdrawal part 34, connected to the lower part of the carbon monoxide rectification part 30.

Moreover, a tube type or shell and coil type condenser evaporator may also be used, as well as a plate-fin type heat exchanger in main condenser evaporator which is used in this embodiment.

Nitrogen gas withdrawn from the above-described carbon monoxide-containing nitrogen gas withdrawal part 33 is introduced into an expansion turbine 11 via a pipe 10 so as to produce cold, and thereafter, the liquefied nitrogen withdrawn from the liquefied nitrogen withdrawal part 34 is introduced into the upper part of an upper column 18 via a pressure reducing valve 16 and a pipe 17.

Nitrogen gas withdrawn from the carbon monoxide-containing nitrogen gas withdrawal part 33 has approximately the same purity as that of nitrogen gas withdrawn from the upper part of the lower column via the pipe 9 of the above-described conventional example. Also, liquefied nitrogen withdrawn from the liquefied nitrogen withdrawal part 34 has approximately the same purity as that of liquefied nitrogen fed into the upper column 18 of the above-described conventional example.

Thus, in this embodiment, liquefied nitrogen in the pipe 17, which is to flow into the upper column 18 as a reflux liquid, has an oxygen concentration of no more than 100 ppm, and usually has only several parts per million, which is close to the oxygen concentration in nitrogen from the conventional installation. Therefore, product nitrogen gas having an oxygen concentration of no more than several parts per million can be obtained from a pipe 23 at the upper part of the upper column 18, in a manner similar to that of the above-described conventional example.

Nitrogen gas having reduced carbon monoxide and liquified nitrogen, which are withdrawn from the flow channels 31*a* and 32*a*, respectively, have a total amount adjusted to no more than 15% of the amount of gas flowing upward (ascending gas) in the carbon monoxide rectification part 30. The ratio of the amount of the reflux liquid which flows into the upper part of the lower column 8 to the ascending gas is adjusted to be no less than 85% (i.e., the reflux ratio is adjusted to be no less than 0.85). It is preferable that the reflux ratio be adjusted to no less than 0.9. In addition, the reflux ratio is adjusted within an appropriate range, taking into consideration that when the reflux ratio is brought near 1, the separation efficiency with respect to carbon monoxide is improved; however, the amount of the nitrogen gas or liquified nitrogen having a reduced amount of carbon monoxide is reduced.

Accordingly, the nitrogen gas withdrawn from the carbon monoxide-containing nitrogen gas withdrawal part 33 is not essential, as long as the above-stated range of the reflux ratio is obtained. Thus, the carbon monoxide-containing nitrogen gas withdrawal part 33 may be installed at another location in the case where a fluid for the expansion turbine is withdrawn from another part.

Furthermore, the number of theoretical plates in the carbon monoxide rectification part 30 is chosen to be no fewer than 10, and preferably no fewer than 14. It may be arbitrarily chosen whether the number of the plates of the carbon monoxide rectification part 30 should be further added to the number of plates of the conventional rectification column, or whether the upper part of the conventional rectification column should be used as the carbon monoxide rectification part 30, and this may be decided depending on the required purity of the highly pure nitrogen product desired. Although an increased number of plates will provide improved separation efficiency of carbon monoxide, the number of plates to be added is chosen by also taking into consideration the production conditions and cost of the rectification column.

Nitrogen gas and liquified nitrogen, each having a carbon monoxide concentration of no more than 0.1 ppm, can be withdrawn from the flow channels 31*a* and 32*a*, respectively, when the lower column 8 is constructed as described above. In addition, oxygen gas and nitrogen gas can be obtained as products from the upper column 18, in the same manner as above.

Since a means for removing hydrogen, helium, neon, or the like, which have boiling points lower than that of nitrogen gas, is not provided in the above-described embodiment of the present invention, nitrogen gas and liquified nitrogen having a reduced amount of carbon monoxide, may still contain such low boiling point components.

Therefore, the low boiling point components may be separated by rectification by introducing the liquified nitrogen withdrawn from the flow channel 32*a* having a reduced amount of carbon monoxide into a low boiling point component separation column 40. The low boiling point component separation column 40 has, at the upper part of the column, a liquefied nitrogen introduction part 41 which receives liquefied nitrogen having a reduced amount of carbon monoxide, and a low boiling point component exhaust part 42, which discharges low boiling point components; and at the lower part of the column, are provided an evaporator 43, a nitrogen gas withdrawal part 44 for withdrawing nitrogen gas having reduced amounts of carbon monoxide, hydrogen and the like, and a liquefied nitrogen withdrawal part 45 for withdrawing liquefied nitrogen having a reduced amount of carbon monoxide.

According to the above rectification process, the liquefied nitrogen, which contains low boiling point components, is introduced into the upper part of the low boiling point component separation column 40 as reflux liquid, and then the liqued nitrogen makes contacts with nitrogen gas ascending in the column which was evaporated by the evaporator 43. The low boiling point components then become concentrated in the upper part of the column. Feed air, liquefied air, gas in any part of the lower column 8, and oxygen gas in the upper column 18 can be used as heating gas in the evaporator 43.

From the low boiling point component exhaust part 42, the low boiling point components concentrated in the upper part is withdrawn via a control valve 46 and a pipe 47, together with a portion of the nitrogen gas. Simultaneously, from the nitrogen gas withdrawal part 44 and the liquefied nitrogen withdrawal part 45 connected to the lower part of the column, an ultrapure nitrogen gas and an ultrapure liquefied nitrogen, from which the low boiling point components have been removed, are withdrawn, respectively.

Accordingly, ultrapure nitrogen from which high boiling point components such as carbon monoxide, and low boiling point components such as hydrogen, are removed can be obtained only by the operation of rectification from the withdrawal parts 44 and 45.

According to the above, additional costs of the facility are incurred for remodeling the rectification column (the lower column 8), for additional apparatus of the low boiling point component separation column 40, and for additional piping. However, the facility is still more economical than a conventional catalytic reaction system. Furthermore, the power consumption of the compressor can be lowered since the pressure loss of the rectification system, which affects the compressor 1 which compresses feed air, is lower than that of the catalytic reaction system.

In a installation producing 13,700 $Nm^3/h$ of a product oxygen gas (GO), 28,000 $Nm^3/h$ of a product nitrogen gas (GN), and 1,000 $Nm^3/h$ of ultrapure liquefied nitrogen (PLN), for example, 66,000 $Nm^3/h$ of feed air (containing 5 ppm carbon monoxide and 5 ppm hydrogen) compressed by the compressor 1 is refined by the adsorber 6, is then cooled by the main heat exchanger 7, is then introduced into the lower column 8 at a pressure of 5 $kg/cm^2G$ and at the temperature of $-172°$ C., and then flows upward in the lower column 8.

From the gas flowing upward (ascending gas), 6,000 $Nm^3/h$ of nitrogen gas (containing 1 ppm oxygen, 5 ppm carbon monoxide, and 5 ppm hydrogen) flowing between the conventional rectification part 8*a* and the carbon monoxide rectification part 30 is withdrawn from the withdrawal part 33 and flows toward the expansion turbine 11. The remainder of the ascending gas (60,000 $Nm^3/h$) flows upwardly in the carbon monoxide rectification part 30 so as to be rectified, and after carbon monoxide is separated and removed, the all gas is introduced into main condenser-evaporator through flow channel 31 and is liquefied by heat-exchanging with the liquefied oxygen in the lower part of the upper column 18 so as to become liquefied nitrogen containing 0.001 ppm oxygen, 0.04 ppm carbon monoxide, 100 ppm hydrogen, and 0.2 ppm argon.

Out of the above liquefied nitrogen, 1670 $Nm^3/h$ thereof flows into the flow channel 32*a*, and the remainder flows into the upper part of the lower column 8 so as to be used as a reflux liquid. At this time, the reflux ratio (L/V) is: 58,330/60,000=0.97.

Approximately half (22,000 $Nm^3/h$) of the above reflux liquid is withdrawn as liquefied nitrogen containing 1 ppm oxygen, 7 ppm carbon monoxide, and 0.2 ppm hydrogen, from the liquefied nitrogen withdrawal part 34 which is connected to the lower part of the carbon monoxide rectification part 30 and is introduced into upper part of upper column 18. 36,330 $Nm^3/h$ of oxygen-enriched liquefied air flows out of the lower part of the lower column 8, then flows into a pipe 20, and is introduced into the middle stage of the upper column 18.

From the upper column 18, 13,700 $Nm^3/h$ of product oxygen gas (having a purity of 99.8%) is withdrawn by a pipe 22 of lower part of the column 18; 28,000 $Nm^3/h$ of product nitrogen gas (containing 1 ppm oxygen, 5 ppm carbon monoxide, and 0.3 ppm hydrogen) is withdrawn by pipe 23 connected to the top of the upper column 18, and 16,030 $Nm^3/h$ of impure nitrogen gas is discharged via a pipe 24.

1,670 $Nm^3/h$ of the liquefied nitrogen flowing into the flow channel 32*a* as described above is introduced as reflux liquid into the upper part of the low boiling point component separation column 40. From low boiling point component separation column 40, 670 $Nm^3/h$ of nitrogen gas which contains low boiling point components is withdrawn via the low boiling point component exhaust part 42, which is connected onto the upper part of the column, and 1,000 $Nm^3/h$ of an ultrapure liquefied nitrogen, containing no more than 0.1 ppm carbon monoxide and no more than 0.1 ppm hydrogen, is withdrawn via the liquefied nitrogen withdrawal part 45 which is connected to the lower part of the column.

Moreover, corresponding to the above-stated amount of the feed air, the pressure loss of a conventional catalytic reaction system is approximately 2,000 mmAq, while that of this embodiment of the present invention (provided that the number of plates of the carbon monoxide rectification part 30 is 14) is approximately 420 mmAq. Therefore, in this embodiment of the present invention, the pressure loss may be reduced by approximately 1500 mmAq, the delivery pressure of the compressor 1 may be reduced by this amount, and accordingly, the required power may be reduced by 50–100 kW.

Figure 2:
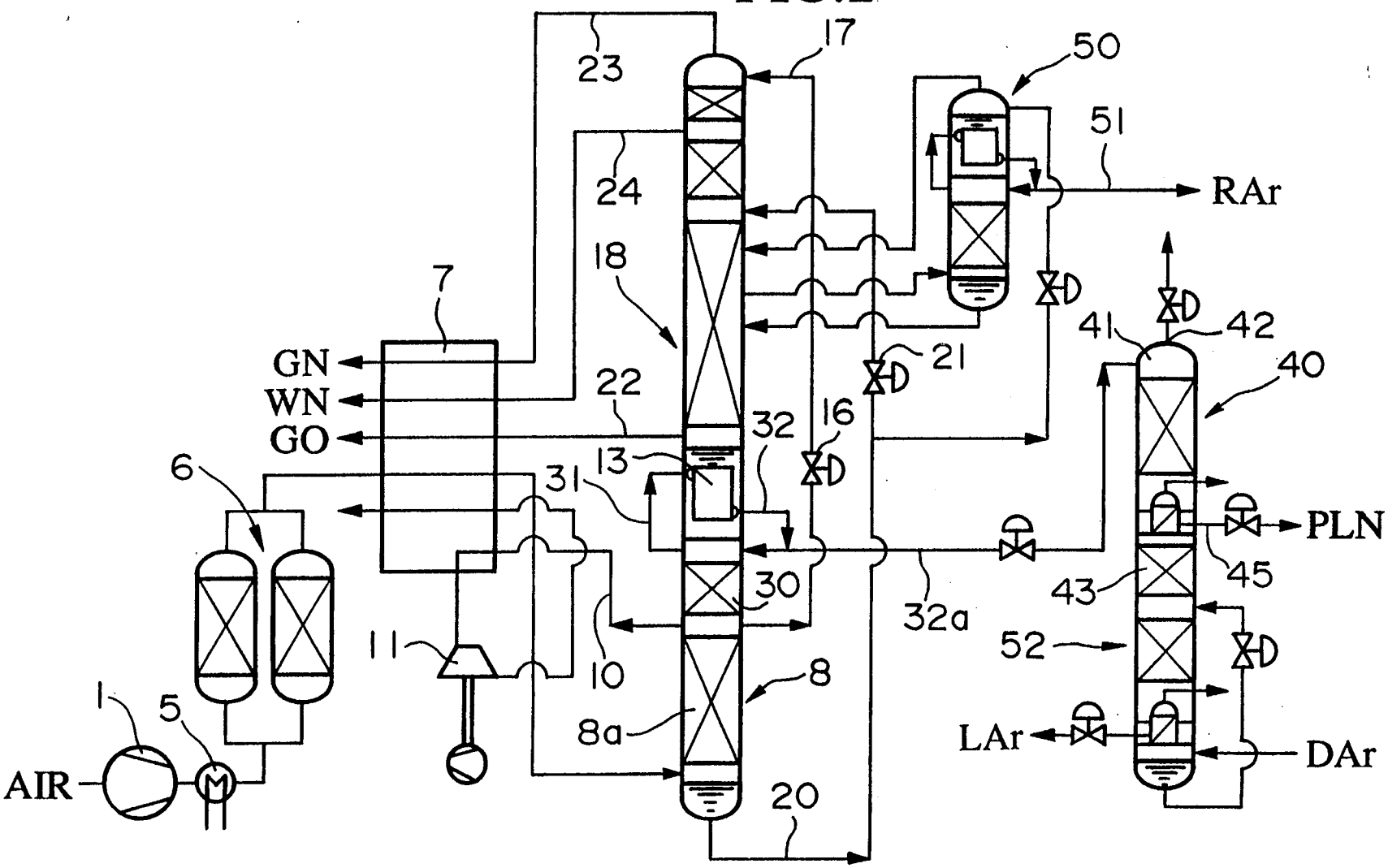
FIG. 2 is a schematic drawing showing a second embodiment of the present invention.

FIG. 2 shows a second embodiment of the present invention, wherein the present invention is applied to an air liquefaction separation installation provided with a facility for isolating argon.

Hence, in the installation according to this embodiment, a crude argon column 50 and a pure argon column 52 are provided. The crude argon column 50 is installed connectively to the upper column 18 so as to obtain crude argon. The argon-containing oxygen gas in the upper column 18 is used in the crude argon column 50 as a feed gas. The crude argon (RAr) is then withdrawn from the crude argon column 50 by a pipe 51 so that oxygen contained in the crude argon (RAr) can be removed by a separate process. The deoxidized argon (DAr) from which oxygen has been thus removed is then introduced into the pure argon column 52 so that liquefied highly pure argon (LAr) can be obtained.

Since the facility for isolating argon can be composed of well-known components of installation, detailed descriptions thereof are omitted. In the case where an element of the following embodiment is identical to an element of the above-described first embodiment, the same number is also attached thereto. Detailed descriptions of such identical elements in the following embodiment are omitted.

In this embodiment, the above-described low boiling point component separation column 40 is provided connectively above the pure argon column 52, while the evaporator 43 at the lower part of the low boiling point component separation column 40 also serves as a condenser for the pure argon column 52.

According to the above, the gas in the pure argon column 52 can be used as a heating source for the evaporator 43 in the low boiling point component separation column 40, while the liquefied nitrogen in the lower part of the low boiling point component separation column 40 can be utilized as a cold source for the condenser.

Figure 3:
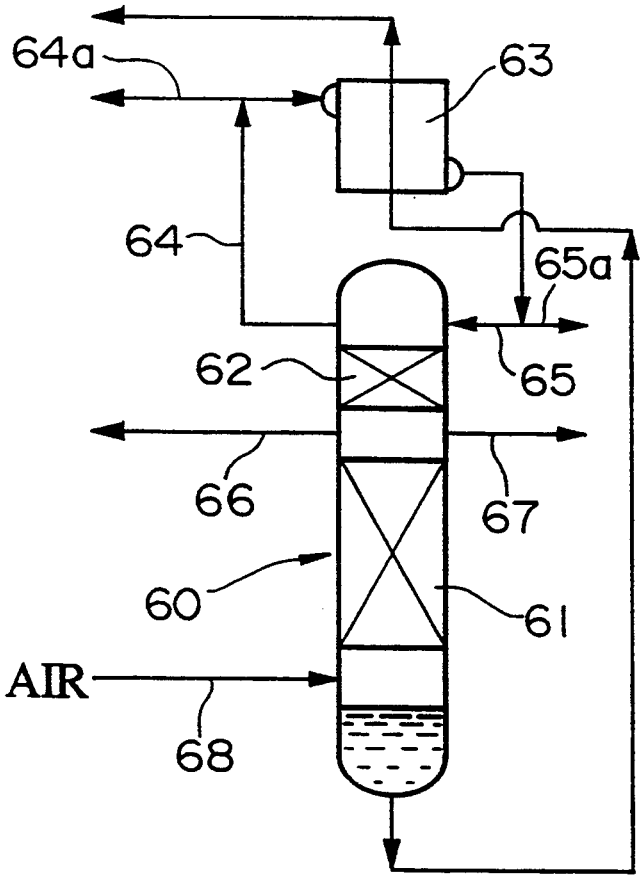
FIG. 3 is a schematic drawing showing the main part of a third embodiment of the present invention.

FIG. 3 shows a third embodiment of the present invention, wherein the present invention is applied to a single rectification column. The single rectification column 60 is provided with:

a carbon monoxide rectification part 62 above a conventional rectification part 61;

flow channels 64, 65, 64*a*, and 65*a* on the upper part of the carbon monoxide rectification part 62, wherein: the flow channel 64 withdraws nitrogen gas, having a reduced amount of carbon monoxide, and then introduces it into a condenser evaporator 63; the flow channel 65 carries nitrogen liquefied by the condenser evaporator 63 to the upper part of the column; and the flow channels 64*a* and 65*a* withdraw a part of the nitrogen gas and a part of the liquefied nitrogen, having a reduced amount of carbon monoxide, respectively; and a carbon monoxide-containing nitrogen gas withdrawal part 66 and a liquefied nitrogen withdrawal part 67, at the lower part the carbon monoxide rectification part 62.

Moreover, both of the above-described nitrogen gas withdrawal part 66 and liquefied nitrogen withdrawal part 67 are not always necessary. The main product of the liquefied or gaseous nitrogen may be withdrawn from which one of the withdrawal parts 66 and 67.

Compressed, refined, and then cooled feed air is introduced into the lower part of the single rectification column 60 via a pipe 68, and then according to a rectification action similar to that of the above-described lower column 8, nitrogen gas, having a reduced amount of carbon monoxide, is concentrated in the upper part of the column, and nitrogen gas and liquefied nitrogen having a reduced amount of carbon monoxide, are withdrawn from the flow channels 64*a* and 65*a*, respectively.

Figure 4:
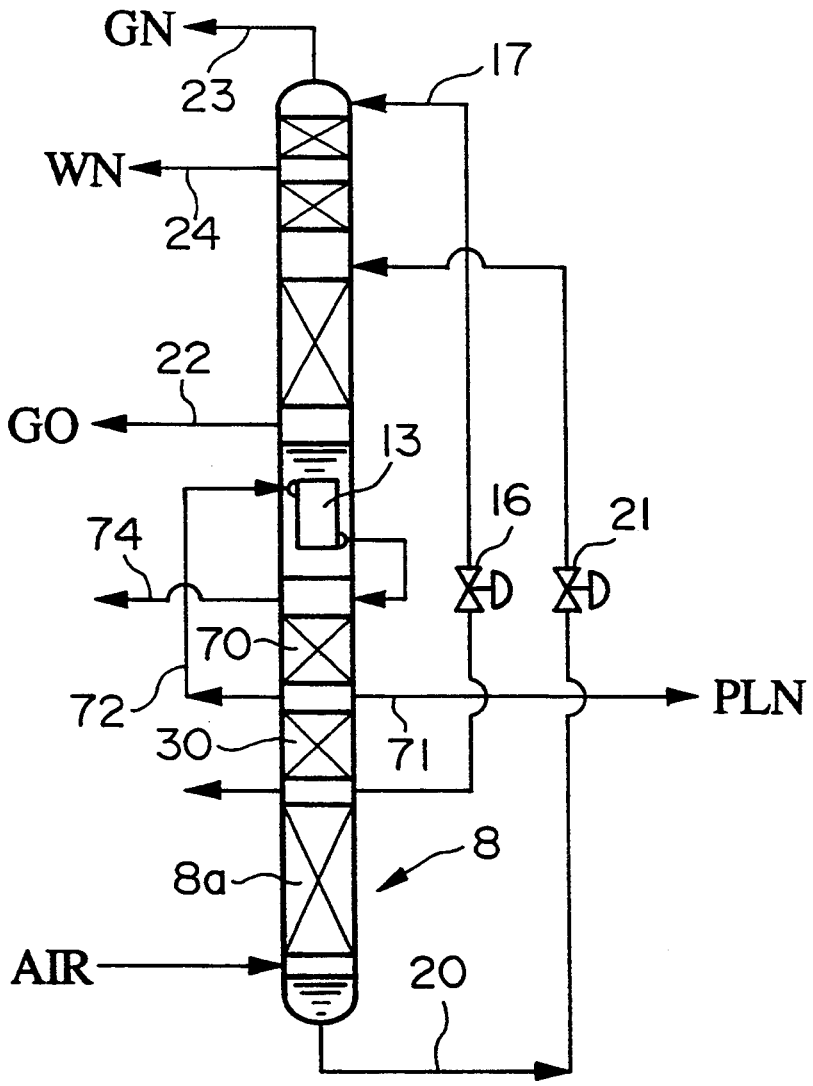
FIG. 4 is a schematic drawing showing the main part of a fourth embodiment of the present invention.
Figure 5:
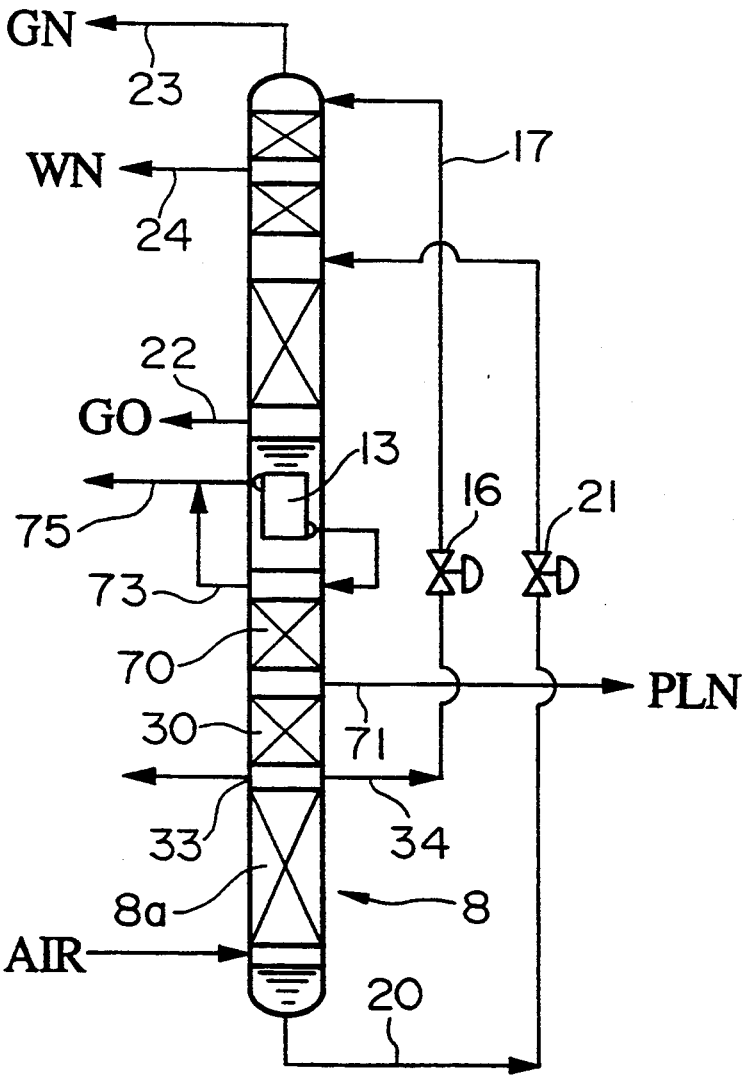
FIG. 5 is a schematic drawing showing the main part of a modified example of the fourth embodiment of the present invention.

FIGS. 4 and 5 show a fourth embodiment of the present invention, wherein a carbon monoxide rectification part 30 is installed above a conventional rectification part 8*a* in a rectification column (lower column 8), and furthermore, a low boiling point component rectification part 70 having a number of the plates from 1 to 5, inclusive, is provided above the carbon monoxide rectification part 30.

In the case where an element of the following embodiment is identical to an element of the above-described conventional installation, the same numeral is also attached thereto. Detailed descriptions of such identical elements in the following embodiment are omitted.

Nitrogen gas having a reduced amount of carbon monoxide, which is concentrated in the upper part of the carbon monoxide rectification part 30, is further rectified by the low boiling point component rectification part 70. Ultrapure liquefied nitrogen, having reduced amounts of carbon monoxide and low boiling point components, is withdrawn from a withdrawal part 71 provided between the low boiling point component rectification part 70 and the carbon monoxide rectification part 30.

According to the embodiment as shown in FIG. 4, a nitrogen gas withdrawal part 72 for withdrawing nitrogen gas having a reduced amount of carbon monoxide is provided between the low boiling point component rectification part 70 and the carbon monoxide rectification part 30 so as to withdraw nitrogen gas therefrom and to introduce the nitrogen gas into the main condensation evaporator 13. According to the embodiment as shown in FIG. 5, nitrogen gas withdrawal part 73 is provided at the upper part of the low boiling point component rectification part 70 so as to withdraw nitrogen gas therefrom and introduce the nitrogen gas into the main condensation evaporator 13.

Furthermore, nitrogen gas wherein low boiling point components are concentrated is withdrawn from a pipe 74 connected to the upper part of the low boiling point component rectification part 70 according to FIG. 4 and from a pipe 75 which branches from the entrance part of the main condensation evaporator 13 according to FIG. 5, respectively. The amount of the nitrogen gas containing low boiling point components is adjusted so that the amount of hydrogen in the ultrapure liquefied nitrogen withdrawn from the withdrawal part 71 is below the predetermined amount.

Moreover, in either embodiment illustrated in FIG. 4 or 5, the liquefied nitrogen which was liquefied by the main condenser evaporator 13 is introduced into the upper part of the low boiling point component rectification part 70, and is then used as reflux liquid in the low boiling point component rectification part 70 and the carbon monoxide rectification part 30.

Accordingly, by additionally providing the low boiling point component rectification part 70 above the carbon monoxide rectification part 30, carbon monoxide and hydrogen can be separated by using only one rectification column, and thus the cost for the facility can be reduced.

In addition, the structures of the installation for air liquefaction separation according to the present invention may be suitably arranged corresponding to the type and quantity of the products to be isolated, and they are therefore not limited to the above-described embodiments. In particular, the rectification column is not limited to a sieve tray column, but may be a packing column wherein regular or irregular packings are provided.

What is claimed is:

1. An air liquefaction separation installation for isolating from compressed, refined, and cooled feed air at least one atmospheric constituent and nitrogen in which the amount of carbon monoxide is reduced, said air liquefaction separation installation having a rectification column into which said feed air is introduced and which carries out liquefaction rectification separation so as to separate said feed air into oxygen-enriched liquefied air and nitrogen gas, said air liquefaction separation installation further comprising:

a carbon monoxide rectification section, located in the upper part of said rectification column, for further rectifying said nitrogen gas so as to separate said nitrogen gas into carbon monoxide-containing nitrogen and nitrogen in which the amount of carbon monoxide is reduced;

a collecting means, connected to the upper part of said carbon monoxide rectification section, for withdrawing a part of said nitrogen in which the amount of carbon monoxide is reduced from said carbon monoxide rectification section; and a carbon monoxide-containing nitrogen withdrawal means, connected to the lower part of said carbon monoxide rectification section, for withdrawing said carbon monoxide-containing nitrogen from said carbon monoxide rectification section.

2. An air liquefaction separation installation according to claim 1, wherein said carbon monoxide rectification section has more than 10 theoretical plates.

3. An air liquefaction separation installation according to claim 1, wherein said air liquefaction separation installation comprises a double rectification column comprising a lower column located in the lower part thereof, and an upper column located in the upper part thereof, and said rectification column comprising said carbon monoxide rectification section in said lower column of said double rectification column; said upper column receiving a part of said carbon monoxide-containing nitrogen, from said carbon monoxide rectification section, as a reflux liquid and said oxygen-enriched liquefied air from said rectification column, and said upper column rectifying a mixture comprising said reflux liquid and said oxygen-enriched liquefied air so as to isolate liquefied oxygen and nitrogen gas from said mixture.

4. An air liquefaction separation installation according to claim 1, wherein said rectification column is a single rectification column.

5. An air liquefaction separation installation for isolating from compressed, refined, and cooled feed air at least one atmospheric constituent and nitrogen in which the amount of carbon monoxide is reduced, said air liquefaction separation installation having a rectification column into which said feed air is introduced and which carries out liquefaction rectification separation so as to separate said feed air into oxygen-enriched liquefied air and nitrogen gas, said air liquefaction separation installation further comprising:

a carbon monoxide rectification section, located in the upper part of said rectification column, for further rectifying said nitrogen gas so as to separate said nitrogen gas into carbon monoxide-containing nitrogen and nitrogen in which the amount of carbon monoxide is reduced;

a condenser evaporator, located above said rectification column, into which a part of said nitrogen in which the amount of carbon monoxide is reduced is introduced, said condenser evaporator liquefying said nitrogen in which the amount of carbon monoxide is reduced into liquefied nitrogen;

a collecting means, connected to said condenser evaporator, for withdrawing a part of said liquefied nitrogen from said condenser evaporator; and a carbon monoxide-containing nitrogen withdrawal means, connected to the lower part of said carbon monoxide rectification section, for withdrawing said carbon monoxide-containing nitrogen from said carbon monoxide rectification section.

6. An air liquefaction separation installation according to claim 5, wherein in addition to said rectification column, said air liquefaction separation installation further comprises a low boiling point component separation column, into which said liquefied nitrogen from said collecting means is introduced, and by which said liquefied nitrogen is separated into nitrogen gas containing low boiling point components and nitrogen in which the amounts of carbon monoxide and low boiling point components are reduced, said low boiling point component separation column having:

a liquefied nitrogen introduction means, connected to the upper part of said low boiling point component separation column, which receives said liquefied nitrogen from said collecting means whereby said liquefied nitrogen is introduced into said low boiling point component separation column as a reflux liquid;

a low boiling point component exhaust means, connected to the upper part of said low boiling point component separation column, for discharging said nitrogen gas containing low boiling point components from said low boiling point component separation column;

an evaporator, disposed in the lower part of said low boiling point component separation column, for evaporating a part of said nitrogen in which the amounts of carbon monoxide and low boiling point components are reduced whereby said part of said nitrogen in which the amount of carbon monoxide and low boiling point components is reduced ascends in said low boiling point component separation column as an ascending gas whereby said ascending gas makes contact with said liquefied nitrogen which is received by said liquefied nitrogen introduction means; and a withdrawal means, disposed in the lower part of said low boiling point component separation column, for withdrawing the other part of said nitrogen in which the amount of carbon monoxide and low boiling point components are reduced.

7. An air liquefaction separation installation according to claim 6, wherein said air liquefaction separation installation further comprises:

a double rectification column comprising a lower column located in the lower part thereof, and an upper column located in the upper part thereof; said rectification column comprising said carbon monoxide rectification section being said lower column of said double rectification column; said upper column receiving a part of said carbon monoxide-containing nitrogen, from said carbon monoxide rectification section, as a reflux liquid and said oxygen-enriched liquefied air from said rectification column, and said upper column rectifying a mixture comprising said reflux liquid and said oxygen-enriched liquefied air so as to isolate liquefied oxygen, nitrogen gas, and argon-containing oxygen gas from said mixture;

a crude argon column which receives said argon-containing oxygen gas from said upper column, and which isolates crude argon from said argon-containing oxygen gas;

an oxygen removing means for removing oxygen from said crude argon, which receives said crude argon from said crude argon column, and which isolates deoxidized argon from said crude argon; and a pure argon column which is provided connectively to said low boiling point component separation column, which receives said deoxidized argon from said means for removing oxygen from said argon, whereby said deoxidized argon is condensed by said evaporator so as to produce liquefied highly pure argon.

8. An air liquefaction separation installation for isolating from compressed, refined, and cooled feed air at least one atmospheric constituent and nitrogen in which the amount of carbon monoxide is reduced, said air liquefaction separation installation having a rectification column into which said feed air is introduced and which carries out liquefaction rectification separation so as to separate said feed air into oxygen-enriched liquefied air and nitrogen gas, wherein said air liquefaction separation installation further comprises:

a carbon monoxide rectification section, located in the upper part of said rectification column, for further rectifying said nitrogen gas so as to separate said nitrogen gas into carbon monoxide-containing nitrogen and nitrogen in which the amount of carbon monoxide is reduced;

a low boiling point component rectification section, disposed above said carbon monoxide rectification section in the upper part of said rectification column, which further rectifies said nitrogen in which the amount of carbon monoxide is reduced so as to separate said nitrogen in which the amount of carbon monoxide is reduced into nitrogen gas which contains low boiling components and liquefied nitrogen in which the amounts of carbon monoxide and low boiling point components are reduced;

a withdrawal means, connected to the upper part of said low boiling point component rectification section, for withdrawing said nitrogen gas which contains low boiling point components from said low boiling point component rectification section;

a withdrawal means, disposed between said low boiling point component rectification section and said carbon monoxide rectification section, for withdrawing said nitrogen in which the amounts of carbon monoxide and low boiling point components are reduced from said carbon monoxide rectification section;

a condenser evaporator, located above said rectification column, into which said nitrogen in which the amount of carbon monoxide is reduced is introduced via said withdrawal means for withdrawing said nitrogen in which the amount of carbon monoxide is reduced, said condenser evaporator liquefying said nitrogen in which the amount of carbon monoxide is reduced into liquefied nitrogen;

an introduction means, connected to the upper part of said low boiling point component rectification section, for introducing said liquefied nitrogen from said condenser evaporator into said low boiling point component rectification section.

9. An air liquefaction separation installation according to claim 8, wherein said low boiling point component rectification section has from 1 to 5 theoretical plates.

10. An air liquefaction separation installation for isolating from compressed, refined, and cooled feed air at least one atmospheric constituent and nitrogen in which the amount of carbon monoxide is reduced, said air liquefaction separation installation having a rectification column into which said feed air is introduced and which carries out liquefaction rectification separation so as to separate said feed air into oxygen-enriched liquefied air and nitrogen gas, wherein said air liquefaction separation installation further comprises:

a carbon monoxide rectification section, located in the upper part of said rectification column, for further rectifying said nitrogen gas so as to separate said nitrogen gas into carbon monoxide-containing nitrogen and nitrogen in which the amount of carbon monoxide is reduced;

a low boiling point component rectification section, disposed above said carbon monoxide rectification section in the upper part of said rectification column, which further rectifies said nitrogen in which the amount of carbon monoxide is reduced so as to separate said nitrogen in which the amount of carbon monoxide is reduced into nitrogen gas which contains low boiling components and liquefied nitrogen in which the amounts of carbon monoxide and low boiling point components are reduced;

a flow channel, connected to the upper part of said low boiling point component rectification section, for withdrawing said nitrogen gas which contains low boiling point components from said low boiling point component rectification section;

a condenser evaporator, located above said rectification column, into which said nitrogen in which the amount of carbon monoxide is reduced is introduced via said flow channel, said condenser evaporator liquefying said nitrogen in which the amount of carbon monoxide is reduced into liquefied nitrogen;

an introduction means, connected to the upper part of said low boiling point component rectification section, for introducing said liquefied nitrogen from said condenser evaporator into said low boiling point component rectification section.

11. An air liquefaction separation installation according to claim 10, wherein said low boiling point component rectification section has from 1 to 5 theoretical plates.

12. An air liquefaction separation process for isolating from compressed, refined, and cooled feed air at least one atmospheric constituent and nitrogen in which the amount of carbon monoxide is reduced, by using a rectification column into which said feed air is introduced and which carries out liquefaction rectification separation so as to separate said feed air into oxygen-enriched liquefied air and nitrogen gas, said air liquefaction separation process comprising the steps of:

further rectifying said nitrogen gas so as to separate said nitrogen gas into carbon monoxide-containing nitrogen and nitrogen in which the amount of carbon monoxide is reduced by using a carbon monoxide rectification section which is provided in the upper part of said rectification column, so that the reflux ratio at said carbon monoxide rectification section is no less than 0.85; and withdrawing said nitrogen in which the amount of carbon monoxide is reduced from the upper part of said rectification column.

* * * * *